US005549331A

United States Patent [19]

Yun et al.

[11] Patent Number: 5,549,331

[45] Date of Patent: Aug. 27, 1996

[54] INLINE SKATEBOARD

[76] Inventors: Young W. Yun, 11400 W. Arrowhead Dr., Hales Corners, Wis. 53130; Lawrence B. Martel, 1212 S. 64 St., West Allis, Wis. 53214; Keith Janick, 716 N. Barstow, Waukesha, Wis. 53186; Ralph J. Bruno, 2405 W. Bolivar, Milwaukee, Wis. 53221

[21] Appl. No.: 499,999

[22] Filed: Jul. 10, 1995

Related U.S. Application Data

[63] Continuation-in-part of Ser. No. 253,680, Jun. 3, 1994, abandoned.

[51] Int. Cl.[6] ..... A63C 17/24; A63C 17/06

[52] U.S. Cl. ..... 280/843; 280/87.042; 280/11.22; 16/26; 301/5.7; 384/49

[58] Field of Search ..... 280/11.22, 843, 280/87.042; 301/5.7; 16/26; 29/898.061, 898.062; 384/49, 50, 51

[56] References Cited

U.S. PATENT DOCUMENTS

| | | | |
|---|---|---|---|
| 616,411 | 12/1898 | Dimmitt | 16/26 |
| 1,616,442 | 2/1927 | De Festenburg et al. | 280/843 |
| 2,198,667 | 4/1940 | Hagenes . | |
| 3,282,598 | 11/1966 | Goodwin . | |
| 3,399,904 | 9/1968 | Schinke | 280/87.042 |
| 3,795,409 | 3/1974 | Cudmore . | |
| 3,856,321 | 12/1974 | Solymosi | 280/87.042 X |
| 3,901,520 | 8/1975 | McMahan | 280/7.13 |
| 4,093,252 | 6/1978 | Rue . | |
| 4,149,735 | 4/1979 | Blackburn et al. | 280/870.042 |
| 4,150,838 | 4/1979 | Lappage . | |
| 4,161,323 | 7/1979 | Wetteland | 280/87.042 X |
| 4,896,893 | 1/1990 | Shumays et al. | 280/87.042 X |
| 5,106,109 | 4/1992 | Tattersall et al. . | |
| 5,125,687 | 6/1992 | Hwang . | |
| 5,127,672 | 7/1992 | Horibata | 280/11.2 X |
| 5,160,155 | 11/1992 | Barachet . | |
| 5,207,454 | 5/1993 | Blankenburg et al. | 280/843 |
| 5,393,077 | 2/1995 | Wanous | 280/11.22 X |
| 5,409,265 | 4/1995 | Douglass | 280/843 |

FOREIGN PATENT DOCUMENTS

| | | | |
|---|---|---|---|
| 3335229 | 6/1985 | Germany | 280/87.042 |
| 461570 | 1/1951 | Italy | 280/7.13 |
| 75917 | 11/1949 | Norway | 280/819 |
| 604785 | 9/1978 | Switzerland | 280/7.13 |
| 164210 | 6/1921 | United Kingdom | 280/11.22 |

*Primary Examiner*—Brian L. Johnson
*Attorney, Agent, or Firm*—Andrus, Sceales, Starke & Sawall

[57] ABSTRACT

An inline skateboard comprised of a board body, a pair of downwardly depending mounting rails integrally formed and smoothly merging from the bottom surface of the board body along a medial position thereof, a plurality of mounting shafts extending transversely across and through the mounting rails and ground engaging, interchangeable transit arrangements mounted on the mounting shafts in at least one of an inboard position between the mounting rails and an outboard position disposed to the outside of the mounting rails. An optional ball wheel is positioned at the end of the board body to define a pivot point which a rider may attain improved stability, balance and turnability.

3 Claims, 3 Drawing Sheets

FIG. 1
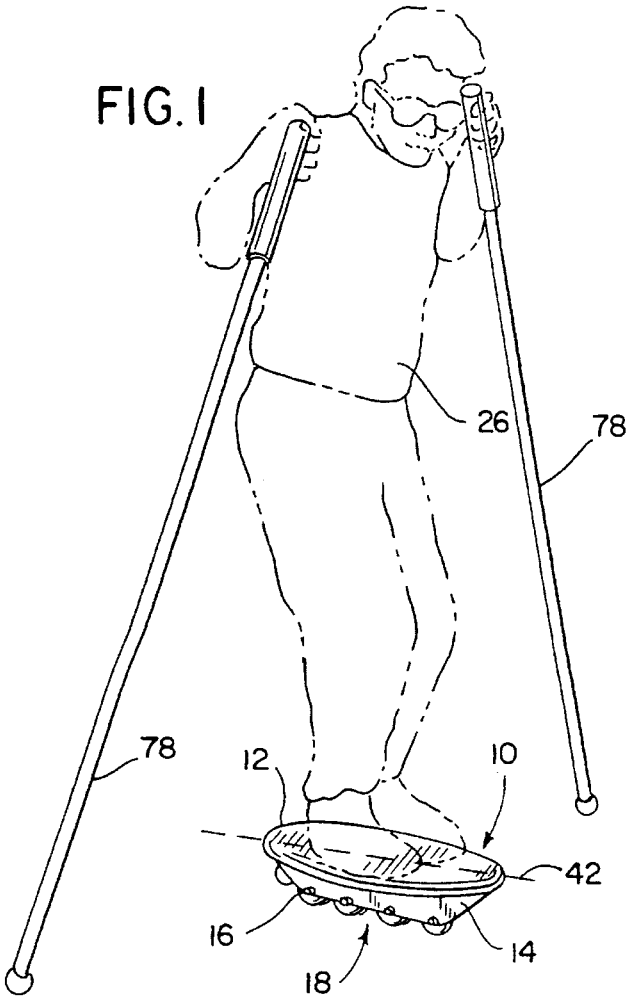
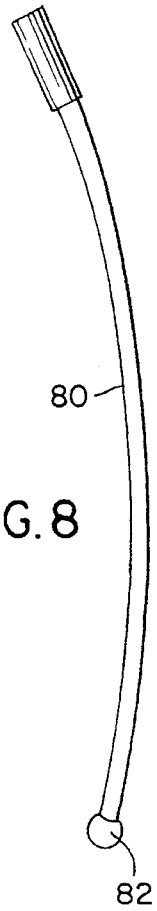
FIG. 8
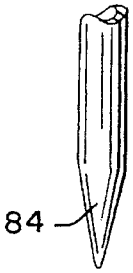
FIG. 9
FIG. 2
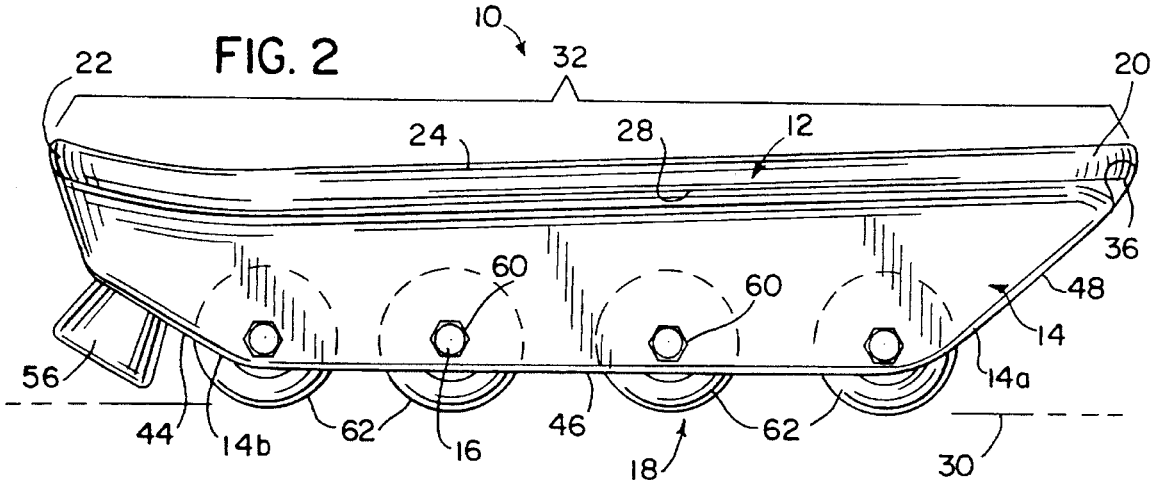

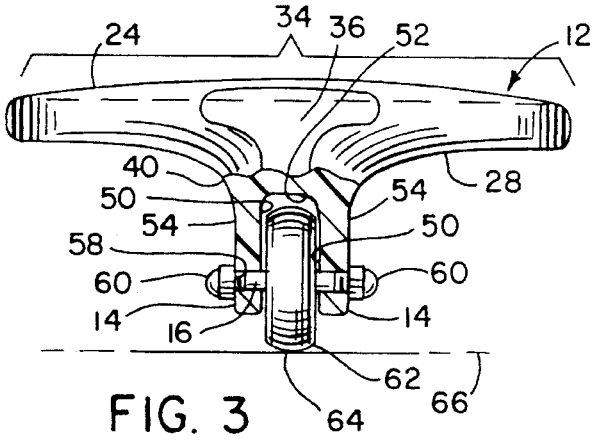
FIG. 3
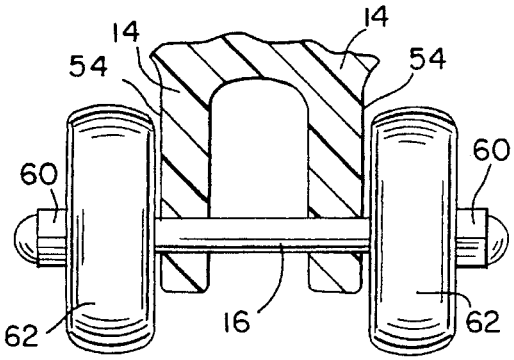
FIG. 4
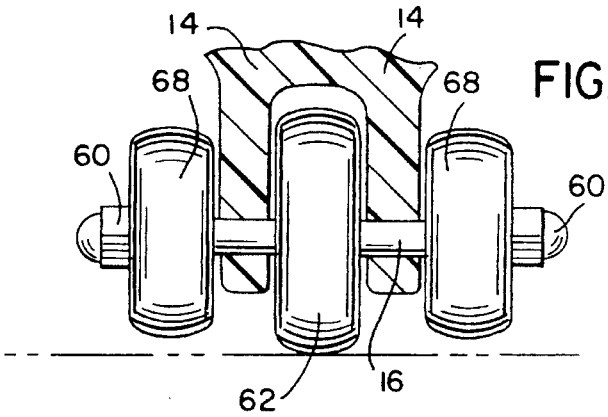
FIG. 5
FIG. 7
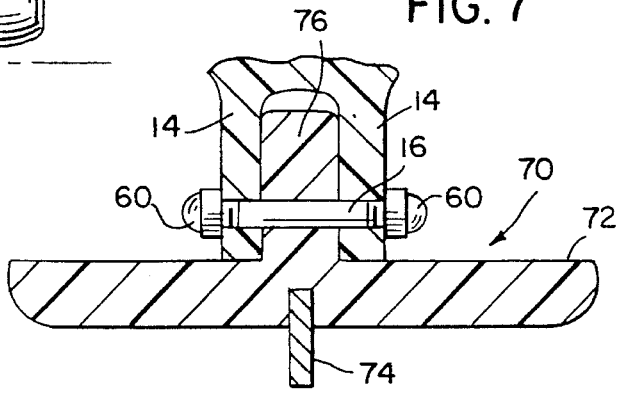
FIG. 6
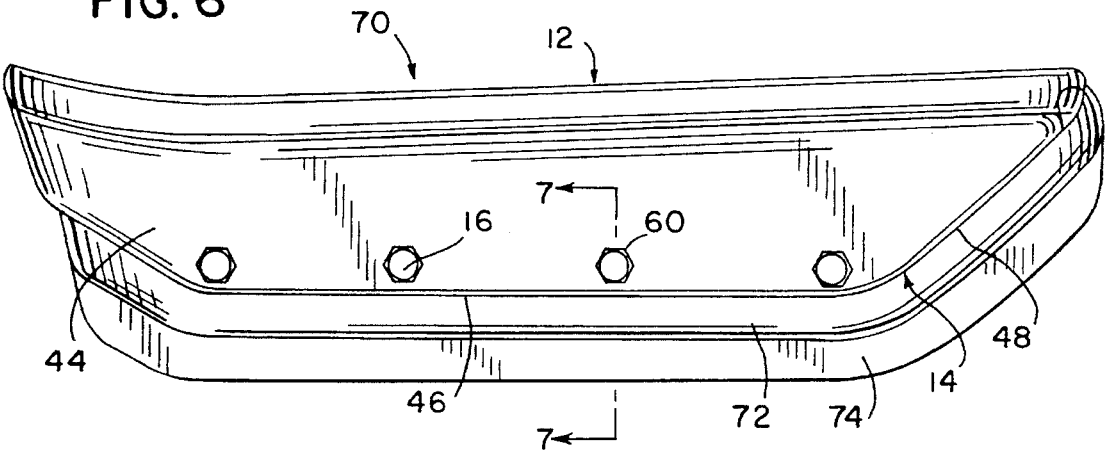

INLINE SKATEBOARD

This is a continuation-in-part application of U.S. patent application Ser. No. 08/253,680 filed Jun. 3,1994, now abandoned.

TECHNICAL FIELD OF THE INVENTION

This invention relates generally to a skateboard used for recreational purposes, and more particularly, pertains to an inline skateboard having interchangeable transit arrangements mounted relative to the longitudinal center line of the skateboard in a manner which establishes various modes of transfer and different levels of skill for a skateboard rider.

BACKGROUND OF THE INVENTION

Rollerskates, rollerblades, skateboards, rollerskis and the like, as means for riding on even terrain such as a road surface have been widely known and used for some time. Skateboards, in particular, have become widely developed and generally comprise a platform large enough for a person to stand on with his or her feet side by side, and a front wheel and a rear wheel mounted for rotation about spaced parallel axes, the wheels being of rounded profile to enable the platform to tilt laterally in use. It is generally intended that the user should stand on the platform with his or her feet on either side of an imaginary line joining the centers of the wheels and should balance himself or herself as the skateboard moves forward.

Such structure, for example, is exemplified in U.S. Pat. No. 3,282,598, issued Nov. 1, 1966 to Goodwin, setting forth a landskier having specially shaped rollers, a plurality of which are mounted between frame members that are in horizontal as well as angular planes, and a drag shoe for controlling speed.

U.S. Pat. No. 3,795,409 issued Mar. 5, 1974, to Cudmore, discloses a wheel coasting device, in which the turning action is produced by a flexing or pivoting of four integral suspension arms, which flexing occurs as the riding platform tilts in response to the changes in the rider's weight distribution on the adjacent platform areas.

U.S. Pat. No. 4,150,838 issued Apr. 24, 1979 to Lappage, sets forth a wheeled carriage whereby the carriage can be used either way up, the platform being above the wheel axis when the carriage is one way up so as to require a high level of skill to maintain the carriage balance, and the platform being below the wheel axis when the carriage is the other way up so as to require a lower level of skill to maintain the carriage balance.

U.S. Pat. No. 5,125,687 issued Jun. 30, 1992, to Hwang, is an example of a rollerski having a board body having two foot holds on both sides of the longitudinal axis throughout, a front roller assembly and a rear roller assembly supported by and disposed under the board body, a brake means, including at least a brake shoe bracket whose end is hingedly mounted at the rear end region of the board body, and at least a spring means interposed between each shoe bracket and the board body. Additional attachments are coupled over the roller assemblies.

U.S. Pat. No. 5,160,155 issued Nov. 3, 1992, to Barachet, shows a skateboard having a non-steering rear wheel preferably close to the center of the board and the rear of the latter, and the front steering wheel remote from the center and mounted in a fork which can be freely oriented about a pivot axis relative to the front of the board, and arranged in a manner such that the pivot axis meets the ground at a point situated forward of the point of contact of the front wheel with the ground.

Unfortunately, most of these previous arrangements are not easy to manufacture, and fail to provide structures which will enable use for a wide variety of differently skilled users. Accordingly, it is desirable to provide an improved skateboard of the modified type from that shown in the aforementioned prior art, which is effective to provide a variety of inline mounting arrangements which will appeal to a large cross-section of riders. It is also highly desirable that such skateboard have a minimum number of components and be economical.

SUMMARY OF THE INVENTION

The inline skateboard of the present invention advantageously provides an exciting recreational vehicle with a choice of attachments for enabling various types of sliding and rolling transport. The skateboard has a unique integral construction, designed for strength, durability and fast installation and removal of attachments in a simple manner.

These and other aspects of the invention are realized in an inline skateboard comprised of a board body having a front edge, a rear edge, a contoured top surface adapted to support a rider thereon, a contoured bottom surface adapted to face the ground terrain, a length and a width. A pair of parallel mounting rails depends downwardly from the bottom surface along a medial portion thereof, each of the mounting rails being spaced equidistantly from the longitudinal center line of and lying coextensive with the length of the board body. A plurality of parallel mounting shafts extends transversely across and through the mounting rails, the mounting shafts having a length substantially shorter than the width of the board body. Ground engaging transit means are mounted on the mounting shafts in at least one of an inboard position between the mounting rails and an outboard position disposed to the outside of the mounting rails.

In another aspect of the invention, an inline skateboard comprises a board body having a front edge, a rear edge, a contoured top surface adapted to support a rider thereon, a contoured bottom surface adapted to face a ground terrain, a length and a width. A pair of downwardly depending parallel mounting rails are integrally formed on and smoothly merge from the bottom surface along a medial portion thereof. Each of the mounting rails are spaced equidistantly from the longitudinal center line of and lie coextensive with the length of the board body. A plurality of parallel mounting shafts extend transversely across and through the mounting rails, each of the mounting shafts having a length substantially shorter than the width of the board body. Interchangeable transit means are confined between the front edge and the rear edge and are mounted on the mounting shafts, the transit means defining at least one horizontal plane relative to the ground terrain.

In yet another aspect of the invention, an inline skateboard kit comprises a board body having a front edge, a rear edge, a contoured top surface adapted to support a rider thereon, a contoured bottom surface adapted to face a ground terrain, a length and a width. A pair of downwardly depending parallel rails are integrally formed on and smoothly merge from the bottom surface along a medial portion thereof, each of the mounting rails being spaced equidistantly from the longitudinal center line of and lying coextensive with the length of the board body. A plurality of parallel mounting shafts extend transversely across and through the mounting rails, each of the mounting shafts having a length substantially shorter than the width of the board body. A first set of wheels of a first predetermined size are mountable on the mounting shafts, and a second set of wheels of a second predetermined size are mountable on the mounting shafts. A snowboard and skateblade attachment are also mountable on the mounting shafts, whereby at least one of the first set of wheels and the second set of wheels are selectably interchangeable with the snowboard and skateblade attachment.

In yet another aspect of the invention, an inline skateboard comprises a board body having a front edge, a rear edge, a continuous, contoured top surface adapted to support a rider's speed at any position thereon, a continuous, contoured bottom surface adapted to face a ground terrain, a length and a width. A pair of parallel mounting rails depends downwardly from the bottom surface along a medial portion thereof to form a U-shaped channel. Each of the mounting rails is spaced equidistantly from the longitudinal center line, lies coextensive with the length of the board body and tapers upwardly at the front edge and the rear edge. Each of the mounting rails also has an inboard side and an outboard side. A plurality of parallel mounting shafts extends across the U-shaped channel, each of the mounting shafts having a length substantially shorter than the width of the board body. Interchangeable transit means are mounted in tandem on the mounting shafts for engagement with the ground terrain. A ball wheel is positioned on the bottom surface for 360° omni-directional rotation at either the front edge or the rear edge. That is, the ball maintains a forward motion as does a regular wheel, but with limited friction rotates in a 360° direction. The ball wheel is solely supported between a pair of fixed races, each of the races being located on an outboard side of the mounting rails and having a plurality of ball bearings alternating in size between a first ball bearing having a first predetermined diameter and a second ball bearing having a second predetermined diameter smaller than the first ball bearing. The ball wheel is rotatably engageable with only the first ball bearings. The ball wheel defines a pivot point on the board body about which the rider attains improved stability, balance and turnability.

In yet another aspect of the invention, an inline skateboard comprises a board body having a front edge, a rear edge, a continuous, contoured top surface adapted to support a rider's feet at any position thereon, a continuous, contoured bottom surface adapted to face a ground terrain, a length and width. A pair of parallel mounting rails depends downwardly from the bottom surface along a medial portion thereof to form a U-shaped channel, each of the mounting rails being spaced equidistantly from the longitudinal center line and lying coextensive with the length of the board body. Each of the mounting rails also has an inboard side and an outboard side. A plurality of parallel mounting shafts extends transversely across the U-shaped channel. Each of the mounting shafts has end portions outwardly biased into engagement with the inboard sides of the mounting rails. Each of the end portions is accessible from the outboard sides of the mounting rails. Interchangeable transit means are mounted on the mounting shafts for engagement with the ground terrain.

BRIEF DESCRIPTION OF THE DRAWINGS

The invention will become better understood by reference to the following detailed description of the preferred exemplary embodiment when read in conjunction with the appended drawing, wherein like numerals denote like elements and;

FIG. 1 is a perspective view of a rider supported on an inline skateboard embodying the present invention;

FIG. 2 is an elevational view of a preferred embodiment of the inline skateboard;

FIG. 3 is an end view taken from the right side of FIG. 2, and showing the mounting rails of the inline skateboard in partial cross-section with one arrangement of transit means;

FIG. 4 is an enlarged detail view in partial cross-section of the mounting rails with a second arrangement of transit means;

FIG. 5 is an enlarged detail view in partial cross-section of the mounting rails with a third arrangement of transit means;

FIG. 6 is an elevational view of an inline skateboard with a snowboard and skateblade attachment;

FIG. 7 is an enlarged detailed view in cross-section showing the mounting of the snowboard and the skateblade to the mounting rails.

FIG. 8 is a view of one of the balancing poles used with the present invention;

FIG. 9 is a fragmentary view of an alternative bottom portion of the balancing poles shown in FIG. 8;

DETAILED DESCRIPTION OF THE PREFERRED EMBODIMENT

Figure 10:
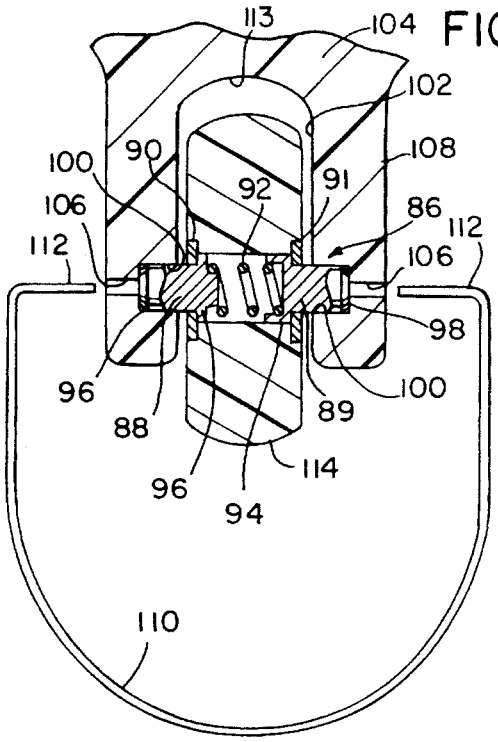
FIG. 10 is a view similar to FIG. 3 showing an alternative mounting shaft and removal tool used in the present invention.
Figure 13:
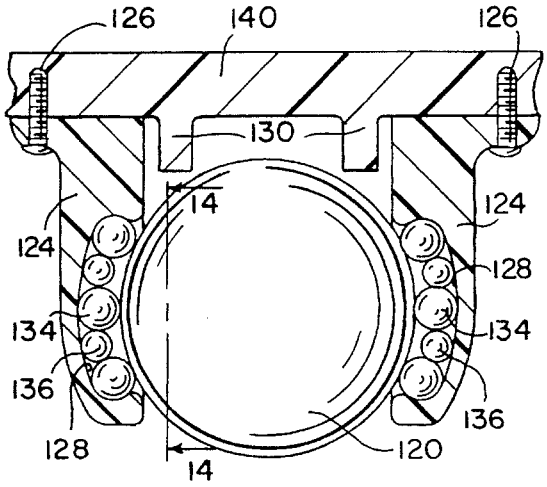
FIG. 13 is a cross-sectional view taken on line 13—13 of FIG. 12.
Figure 12:
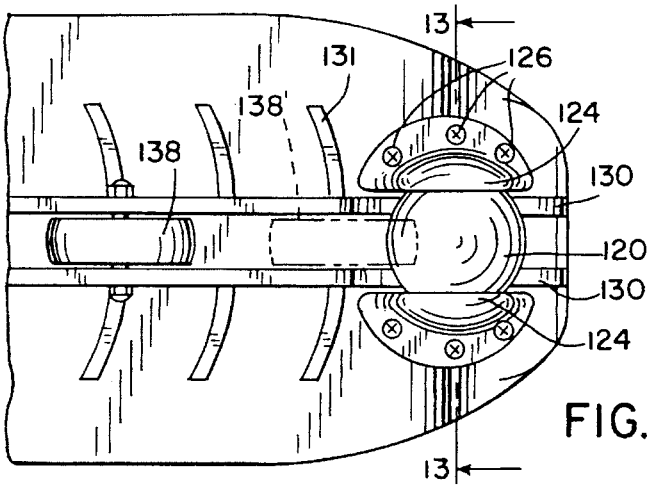
FIG. 12 is a cross-sectional view taken on line 12—12 of FIG. 11.
Figure 14:
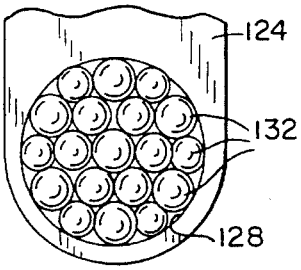
FIG. 14 is a cross-sectional view taken on line 14—14 of FIG. 13.
Figure 11:
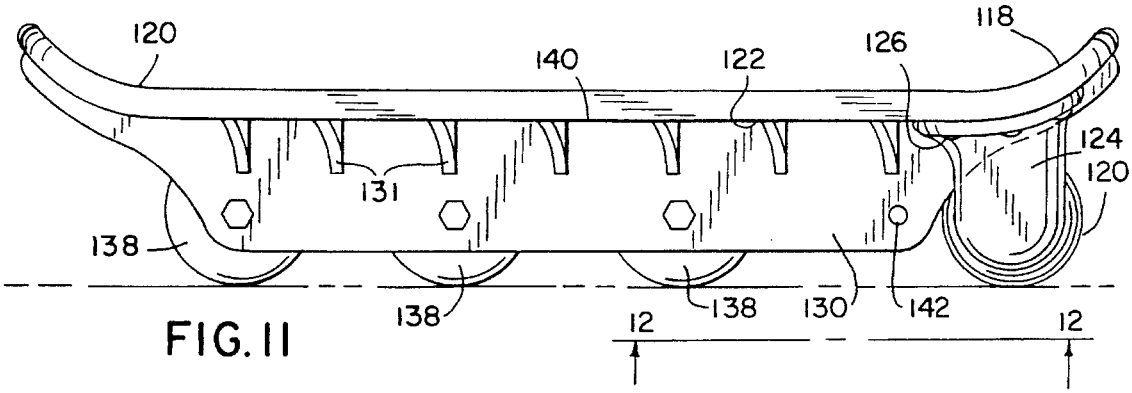
FIG. 11 is a view similar to FIG. 2 of an optional ball wheel positioned at one end of the inline skateboard.

Referring now to FIGS. 1–3, an inline skateboard 10 embodying the present invention includes a board body 12, a pair of parallel mounting rails 14, a plurality of mounting shafts 16 and ground engaging transit means 18.

Board body 12 is somewhat aerodynamically designed to exhibit air resistance and an especially aesthetic appearance. In particular, board body 12 has a front edge 20, a rear edge 22, a contoured top surface 24 adapted to support a rider 26 thereon, a contoured bottom surface 28 adapted to face a ground terrain 30, a length 32 and a width 34. Board body 12 is designed such that a rider's feet may be positioned next to each other, as shown in FIG. 1, or alternatively one foot in front of the other. Front edge 20 is provided with a resilient bumper 36 used to protect the board body 12 upon impact with foreign objects.

Focusing now on FIG. 3, a feature of the invention resides in the board body 12 being integrally formed with a pair of parallel mounting rails 14 depending downwardly and merging smoothly from bottom surface 28 along a medial portion 40 thereof, such that a cross section of board body 12 and mounting rails 14 is generally T-shaped. Each of mounting rails 14 is spaced equidistantly from the longitudinal centerline 42 and lies coextensively along the length 32 of board body 12. As seen in FIG. 2, each of the mounting rails 14 has inclined rear surfaces 44, a central horizontal surface 46 and inclined front surfaces 48. Mounting rails 14 have an inboard side 50 in an inverted U-shaped mounting space 52 defined by the separated mounting rails 14 and an outboard side 54 located to the immediate outside of each mounting rail 14. Each of mounting rails 14 has a front portion 14*a* and a rear portion 14*b*, the rear portion being provided with a braking shoe 56.

A plurality of mounting shafts 16 having a width substantially shorter than board body 12 extend transversely across and through apertures 58 in mounting rails 14. The ends of mounting shafts 16 are threaded and provided with nuts 60 on both ends for a purpose to be appreciated hereafter. In the preferred embodiment, four mounting shafts 16 are provided, but this number may be altered as desired.

As a salient feature of the invention, ground engaging transit means 18 are confined between the front edge 20 and the rear edge 22 of the board body 12 and are mounted on mounting shafts 16. In the preferred embodiment shown in FIGS. 1–3, transit means 18 comprises a plurality of aligned wheels 62 having a uniform diameter of a first predetermined size. Wheels 62 are mounted for free rotation on mounting shafts 16 and held in a mounting space 52 between mounting rails 14 by nuts 60 on the ends of mounting rails 14. As seen in FIG. 3, wheels 62 are all mounted at a common elevation so that their bottom surfaces 64 define a horizontal plane relative to the ground terrain 66. It can also be said that wheels 62 extend along the central horizontal surfaces 46 of mounting rails 14. This arrangement presents the greatest challenge and requires the most skill of a rider due to the singular inline configuration.

In a second arrangement depicted in FIG. 4, two sets of aligned wheels 62 are mounted on mounting shafts 16, one set each being disposed on each outboard side 54 of mounting rails 14 and prevented from falling off by nuts 60. A third arrangement illustrated in FIG. 5 shows a first set of aligned wheels 62 mounted inboard mounting rails 14 and a second set of wheels 68 of a second predetermined size smaller than the first set of wheels 62 mounted outboard the mounting rails 14. Wheels 68 operate in a training wheel capacity used by a rider in further developing his or her balancing skills.

While the arrangements shown in FIGS. 1–5 are designed primarily for rolling contact on hard surfaces, FIGS. 6 and 7 contemplate a seasonal attachment 70 comprising a combination snowboard 72 and a skateblade 74 mounted perpendicular thereto and extending downwardly for sliding contact on snow and ice surfaces in winter-like terrain. In contrast with the wheeled arrangements previously described, attachment 70 has an upstanding portion 76 which is disposed between mounting rails 14 for substantially the entire length thereof. Otherwise stated, attachment 70 extends along the inclined rear surfaces 44, the central horizontal surface 46 and the inclined front surfaces 48 of mounting rails 14.

It should now be appreciated that transit means 18 is selectively interchangeable in various combinations to define an inline skateboard 10 capable of being used by riders of all kinds. It can also be stated that the transit means 18 are mounted on mounting rails 14 in at least one of an inboard position between mounting rails 14 and an outboard position disposed to the outside of mounting rails 14. Inline skateboard may be offered as a kit or assembly comprising combinations of board body 12, two first sets of wheels 62, a second set of wheels 68, seasonal attachment 70 and a set of optional balancing and driving poles 78, 80. Poles 78 (FIG. 1) have a straight configuration while poles 80 (FIG. 8) have a slightly curved shape. The bottom of poles 78, 80 may either have a resilient round end 82 (FIG. 1) or a pointed end 84 (FIG. 9).

In use, the desired inline skateboard arrangement is attained simply by removing nuts 60 and attaching to mounting rails 14 the desired combination of wheels 62, 68 or attachment 70 with replacement of nuts 60 depending on the extant terrain. Once the desired arrangement is available, a rider mounts inline skateboard by placing both feet on board body 12 while it is leaning on its edge and rights board body 12 by use of poles 78 or 80. The rider then commences his or her ride by leaning forward slightly and pushing off with poles 78 or 80. The greater the speed generated, the easier it becomes to maintain one's balance. While in motion, turning is achieved by shifting the rider's weight with one foot in front of the other and tipping the board body 12 to one side or the other. In some circumstances, such as on decline surfaces, it is not absolutely necessary to employ poles 78 or 80.

It should be understood from a manufacturing standpoint that board body 12 and mounting rails 14 are integrally and durably configured and that the smoothly merging connection between these two components contributes to the aesthetic appearance of the inline skateboard 10. Furthermore, it should be appreciated that the inline skateboard 10, because of its interchangeable transit means 18, provides several different combinations, each of which creates a recreational vehicle which offers varying levels of challenge to a wide segment of riders. It should likewise be appreciated that the installation and removal of transit means 18 is a simple operation requiring no special tools or mechanical skills.

Referring now to FIG. 10, mounting shaft 86 has an alternative construction comprising first and second members 88, 89 slidably engageable in respective guides 90, 91. Included between members 88, 89 is a spring 92, one end of which abuts a stop 94 on second member 89 and the other end of which abuts a collar 96 formed on first member 88. Members 88, 89 have respective solid end portions 96, 98 outwardly biased into engagement with the walls of a first aperture 100 formed on the inboard side 102 of each mounting rail 104. A second aperture 106 smaller in diameter than that of the first aperture 100 is formed on the outboard side 108 of each mounting rail 104 and is in communication with the first aperture 100. A tool 110, preferably U-shaped with bent ends 112 is insertable in the apertures 100, 106 and engageable with solid end portions 96, 98 to push end portions 96, 98 inwardly against the bias of spring 92 until mounting shaft 86 is maneuvered into U-shaped channel 113 after which the wheel 114 and/or mounting shaft 86 may be replaced.

Referring now to FIG. 11–14, inline skateboard 116 has an upturned front edge 118 and an upturned rear edge 120. At one edge thereof, preferably the front edge, an optional, axleless spherical means in the form of a ball wheel 120, employed preferably as a training device, is positioned beneath the bottom surface 122 for 360° omni-directional rotation. A pair of downwardly depending mounting arms 124 are attached to the bottom surface 122 with fasteners 126 to form a pair of fixed races 128. Positioned on the outboard side of mounting rails 130 which taper upwardly at both the front edge 118 and the rear edge 120. In this design, a plurality of ribs 131 reinforce the mounting rails 130 with the bottom of the skateboard. Each of the races 128 carries a plurality of ball bearings 132 alternating in size between a first ball bearing 134 having a first predetermined diameter and a second ball bearing 136 having a second predetermined diameter smaller than the diameter of the first ball bearing 134. It is the provision of the alternating sized ball bearings 132 and axleless design which enable ball wheel 120 to turn in all directions with limited friction. Ball wheel 120, which has a diameter substantially similar to wheels 138 and a bottom lying in the same horizontal plane, is solely supported between the races 128 and is engageable with only the first ball bearings 134 to provide a friction reduced pivot point on the board body 140 about which the rider attains improved stability and turnability as he or she shifts his or her weight to obtain a "tic-tak" or slalom motion. With the above-described arrangement, a rider may propel himself or herself in the forward direction and still have the ability to maintain balance in a lateral direction as he or she repositions his or her feet due to the multi-directional movement of the ball wheel 120. It can be appreciated that use of the optional ball wheel 120 will enable a rider to increase his or her speed and mobility and face more challenging terrains or courses.

It should also be appreciated that, once the ball wheel 120 has fulfilled its preferred training purpose, it may be removed and replaced by one or more wheels 138' at 142. Likewise, it should be understood that an experienced rider would find the inline skateboard extremely challenging by removing the two middle wheels 138 and riding on wheels 138, 138' positioned only near the front edge 118 and rear edge 120.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

We claim:

1. An inline skateboard comprising:

a board body having a front edge, a rear edge, a continuous, contoured top surface adapted to support a rider's feet at any position thereon, a continuous, contoured bottom surface adapted to face a ground terrain, a length and a width;

a pair of parallel mounting rails depending downwardly from said bottom surface along a medial portion thereof to form a U-shaped channel, each of said mounting rails being spaced equidistantly from the longitudinal center line, lying coextensive with the length of said board body and tapering upwardly at said front edge and said rear edge;

each of said mounting rails having an inboard side and an outboard side;

a plurality of parallel mounting shafts extending across said U-shaped channel, said mounting shafts having a length substantially shorter than the width of said board body;

interchangeable transit means mounted in tandem on said mounting shafts for engagement with said ground terrain; and axleless spherical means positioned on said bottom surface for 360° omni-directional rotation at one of the front edge and rear edge, said spherical means being solely supported between a pair of fixed races, each of said races located on said outboard-side of said mounting rails and having a plurality of ball bearings alternating in size between a first ball bearing having a first predetermined diameter and a second ball bearing having a second predetermined diameter smaller than said first ball bearing, said spherical means being rotatably engageable with only said first ball bearings;

said spherical means defining a pivot point on said board body about which the rider attains improved stability, balance and turnability.

2. The inline skateboard of claim 1, wherein the bottom of said transit means and said spherical means lies in the same horizontal plane.

3. The inline skateboard of claim 1, wherein the diameter of said transit means and said spherical means is substantially identical.

* * * * *